US011059284B2

(12) United States Patent
Hedges

(10) Patent No.: US 11,059,284 B2
(45) Date of Patent: Jul. 13, 2021

(54) SLEEVE FOR A BRIDGE MANDREL, AND A BRIDGE MANDREL AND SLEEVE ASSEMBLY

(71) Applicant: SANDON GLOBAL ENGRAVING TECHNOLOGY LTD, Runcorn (GB)

(72) Inventor: Nigel Hedges, Runcorn (GB)

(73) Assignee: Sandon Global Engraving Technology Limited, Runcorn (GB)

( * ) Notice: Subject to any disclaimer, the term of this patent is extended or adjusted under 35 U.S.C. 154(b) by 256 days.

(21) Appl. No.: 15/778,798

(22) PCT Filed: Nov. 17, 2016

(86) PCT No.: PCT/EP2016/077989
§ 371 (c)(1),
(2) Date: May 24, 2018

(87) PCT Pub. No.: WO2017/089221
PCT Pub. Date: Jun. 1, 2017

(65) Prior Publication Data

US 2018/0345656 A1 Dec. 6, 2018

(30) Foreign Application Priority Data

Nov. 26, 2015 (GB) ..... 1520915

(51) Int. Cl.
*B41F 31/26* (2006.01)
*B41F 31/36* (2006.01)
*B41N 7/06* (2006.01)

(52) U.S. Cl.
CPC ..... *B41F 31/26* (2013.01); *B41F 31/36* (2013.01); *B41N 7/06* (2013.01); *B41P 2200/12* (2013.01)

(58) Field of Classification Search
CPC . B41F 31/26; B41F 13/08; B41N 7/00; B41N 7/06
See application file for complete search history.

(56) References Cited

U.S. PATENT DOCUMENTS 4,383,483 A 5/1983 Moss
4,386,566 A 6/1983 Moss
(Continued)

FOREIGN PATENT DOCUMENTS

EP 0791477 A2 8/1997
JP 62-19457 A 1/1987

OTHER PUBLICATIONS

International Search Report for PCT/EP2016/077989, dated Mar. 2, 2017.

(Continued)

*Primary Examiner* — Leslie J Evanisko
*Assistant Examiner* — Leo T Hinze
(74) *Attorney, Agent, or Firm* — John H. Choi & Associates LLC

(57) ABSTRACT

A substantially tubular interchangeable sleeve is adapted for applying a printing or coating liquid to a substrate material or offset roller. The sleeve has a multi-layer construction primarily consisting of a first outer layer of a dimensionally stable substantially fluid-impregnable solid material, such as aluminum or steel, around the exterior surface of which is affixed or applied a print or coating liquid receiving plate or layer. The sleeve further comprises one or more further interior layers of relatively less dimensionally stable, compressible, usually fibrous materials disposed inwardly of the interior surface of the first layer which, under air pressure, can be compressed so as to enlarge the inner dimensions of the sleeve so that it can be slid over a suitable bridge mandrel. The sleeve further comprises at least one end ring (Continued)

of a dimensionally stable substantially fluid-impregnable solid material.

13 Claims, 4 Drawing Sheets

(56) References Cited

U.S. PATENT DOCUMENTS

| | | | | |
|---|---|---|---|---|
| 4,503,769 | A | 3/1985 | Andersen | |
| 4,651,643 | A | 3/1987 | Katz | |
| 4,864,926 | A | 9/1989 | Saueressig | |
| 5,840,386 | A * | 11/1998 | Hatch | B41F 27/105 428/36.9 |
| 6,276,271 | B1 | 8/2001 | Busshoff | |

OTHER PUBLICATIONS

Written Opinion for PCT/EP2016/077989, dated Mar. 2, 2017.
European Patent Office, EP Application No. 16798694.2, Sep. 13, 2018 Office Action.
European Patent Office, EP Application No. 16798694.2, Dec. 12, 2018 Response to Office Action.

* cited by examiner

SLEEVE FOR A BRIDGE MANDREL, AND A BRIDGE MANDREL AND SLEEVE ASSEMBLY

CROSS-REFERENCE TO RELATED APPLICATION

This application is a national stage application of PCT/EP2016/077989, filed on Nov. 17, 2016, which claims priority to GB1520915.8, filed Nov. 26, 2015, each of which is incorporated by reference in its entirety.

FIELD OF THE INVENTION

The present invention relates to a sleeve for a bridge mandrel, being most commonly provided in print machinery, and to the combined assembly of bridge mandrel and such a sleeve. More specifically, the invention relates to an interchangeable annular sleeve adapted for use in rotary web- or sheet-fed printing or coating machinery in which one or more of the plurality of rolls (or rollers) therein comprises a spindle (or arbor, for which the term 'spindle' used herein should be considered as interchangeable) on which a bridge mandrel is securely mounted so that said annular sleeve can be quickly, easily and safely removed and replaced without any requirement for altering or removing the other components of the system.

It should be mentioned from the outset that the present invention should be considered as encompassing both the sleeve itself, and the combined assembly of bridge mandrel and sleeve, and that, although the majority of the following description is provided with almost exclusive reference to the use of sleeves and assemblies comprising them in rotary printing and coating machinery, the invention should not be construed as being limited to machinery having such specific applications. Indeed, it is contemplated that the present invention may find application within rotary machinery of any kind, but which in general will comprise one or more roller components which

- has a working surface which comes into contact with, or to which is applied, a liquid,
- is of composite or multi-layer construction, and for which it is desirable that ingress of the liquid into the materials from which one or more of the layers is constructed should be prevented, and
- often or intermittently require replacement, maintenance or alteration.

BACKGROUND TO THE INVENTION

In rotary printing presses, and in particular those adapted for flexographic printing, there is commonly provided what is known as an Anilox roll. The Anilox is, in general terms, a method used to transfer a measured amount of ink to a flexographic printing plate, and the Anilox roll which achieves the desired ink film weight is usually a hard cylinder having a steel or aluminum core, the outer cylindrical surface of which is coated by an industrial ceramic (Chromium(III) oxide, $Cr_2O_3$, being most common) whose surface contains millions of microscopic dimples, known as cells, most commonly created by laser engraving. The Anilox roll may be either semi-submerged in an ink fountain or in contact with a chamber doctor blade system, or it may be disposed within the press such that it is in contact with a so-called metering roller, which is semi-submerged in the ink fountain. In any case, a layer of typically viscous ink is deposited on the Anilox roll, and a doctor blade or equivalent device is used to scrape excess ink from the surface leaving just a measured amount of ink in the cells. The roll then rotates into contact with a print cylinder on which a photopolymer flexographic printing plate is mounted so that the plate receives precisely the correct quantity of ink from the cells, and in precisely the correct position on said plate for ultimate transfer to the print substrate material.

Precisely the same technique can be used for transferring coatings such as varnishes and lacquers to already printed substrate material, and indeed Anilox rolls having precisely uniform patterns of identical cells are employed to transfer uniformly thick (e.g. tens or hundreds of μm) coatings to pre-printed substrates. Such coatings are usually applied to protect the previously printed inks, and to prevent them from being later eroded or "rubbed off" when the substrate is being handled. In can or metal decoration print machinery for instance, Anilox rolls are used to apply a layer of varnish to a pre-printed can body. The Anilox roll within this market segment is referred to as a Gravure or coating cylinder.

There are many problems associated with what shall hereinafter be referred to as 'wet' rolls within printing machinery, being those rolls whose outer cylindrical surfaces come into contact with, or have applied thereto, often chemically aggressive printing liquids such as inks, varnishes and lacquers, and whose purpose is generally to precisely transfer a predetermined quantity of that liquid to either the print substrate itself or (in offset techniques) an impression roller with every (or in some cases, every other) revolution. One of the most fundamental problems arises from the physical size and weight of the existing Gravure cylinders themselves—they are intrinsically unwieldy, and removing and replacing, or repairing them, is a time-consuming and difficult procedure, in particular when the delicacy of their Chromium Oxide ceramic coatings necessitates very careful handling.

Those skilled in the art have identified this problem, and proposed the solution of adapting certain of the wet rolls within print machinery by removing the roller from the belt or sprocket-driven spindle on which it is mounted, and inserting a bridge mandrel on the spindle in its place, the bridge mandrel being so-called because it forms a mechanical bridge between the drive spindle and a cylindrical annular print or coating sleeve (for example having a Chromium Oxide ceramic exterior coating as described above) which is subsequently slid axially over the exterior surface of the bridge mandrel into some desired position thereon. Once in position, a releasable locking mechanism is deployed which acts between mandrel and sleeve to secure the sleeve in place thereon. As will be readily understood, this arrangement immediately offers operatives the facility for removing and replacing only the lightweight Gravure coating sleeve, as opposed to the heavy and cumbersome Gravure coating cylinder, and therefore modifications and repairs can be accomplished much more safely, efficiently and easily.

Examples of known bridge mandrel and sleeve assemblies, and the different types of locking mechanisms employed to secure one to the other, can be found in the following prior art documents:

U.S. Pat. No. 4,651,643 discloses annular adapters for expandable mandrels of printing presses which are slidable over end journals of the mandrel and lockable thereto. The adapters each have an outwardly expandable diaphragm-like external periphery for gripping and holding a printing cylinder of a diameter larger than that of the mandrel. The diaphragms are expanded radially outwardly into locking engagement with the inner surface of the print cylinder by introducing and pressurizing hydraulic fluid in a closed chamber so that the printing sleeve is secured both axially and rotationally with respect to both the adapters and in turn the mandrel to which they are similarly secured. U.S. Pat. Nos. 4,383,483 and 4,386,566 also provide examples of mandrel and sleeve assemblies wherein hydraulic fluid under pressure is used as the locking mechanism whereby a sleeve is secured to the mandrel).

U.S. Pat. No. 4,503,769 discloses a lightweight, thin walled, plural metal coated plastic sleeve for use in rotogravure or flexographic printing as well as a rotogravure printing cylinder incorporating such a sleeve. The sleeve itself is of a multi-layer construction, typically including a hollow cylinder of a phenolic resin or polyester containing fiber reinforcements (e.g., glass fiber) to an outer roughened surface of which is applied a zinc layer. A copper layer 33 is then sprayed by plasma spray onto the zinc surface to produce a basic gravure core. For a rotogravure cylinder, a further layer of copper is electrolytically deposited, and the outer surface of this layer is then polished and engraved, after which a hard surface coating of chromium or tungsten carbide is then applied. The sleeve is mechanically locked to the mandrel by means of a pair of split rings at either end of the mandrel, each having a series of axially extending fingers which are deflected radially outwardly as the mandrel is screwed to the spindle which supports it.

U.S. Pat. No. 6,276,271 discloses a bridge mandrel construction which is simple to manufacture, light weight, and easy to mount and dismount from underlying printing cylinders in flexographic and gravure printing systems. The bridge mandrel includes a generally hollow, cylindrically-shaped tube adapted to fit over a print cylinder and, by means of bayonet-like fixings, be mechanically locked thereto. A channel extends substantially around the circumference of the inner surface of the mandrel, and a plurality of orifices extends generally radially outwardly from the channel to the outer surface of the tube to permit pressurized air to be provided from the interior of the mandrel to its surface for the mounting of a print sleeve onto the mandrel. The mandrel may possess a multi-layer construction comprising a rigid base layer of metal or rigid polymer (e.g. glass-fiber reinforced polyester), an intermediate layer of polymer foam (e.g. polyurethane foam) which may be either rigid or compressible, and a surface layer which is preferably compressible, e.g. an open- or closed-cell compressible foamed polymer. The print sleeve is manufactured from a layer of compressible material so that when air pressure is supplied to an interior chamber of the printing cylinder, it permeates through to the exterior surface of the mandrel so as to slightly expand the print sleeve so that it can be removed and replaced. Removing the supply of pressurized air causes the print sleeve to contract around the mandrel and the resulting interference fit firmly secures the print sleeve in place on the mandrel.

Despite the advances disclosed above, there are still disadvantages which are yet to be fully overcome, particularly in the metal decorating/can printing industry, and particularly as regards coating rolls, as opposed to the print rolls with which all of the above prior art is concerned. For coating rolls (and Gravure coating cylinders), there is of course no requirement that the roll or cylinder be precisely rotationally positioned relative to the drive spindle as there is no requirement for precise registration of the surface of the roller with the print substrate. All that is required is that the coating roll applies a precisely uniform layer of varnish or lacquer to the print substrate as it comes into contact therewith.

Attempts have been made to adapt the above known bridge mandrel and sleeve assemblies for coating rolls, for example by retro-fitting machinery with mandrels which can receive a supply of pressurized air and which is distributed around their exterior surfaces to expand a removable Gravure coating sleeve interferingly fitted thereto. However, current coating sleeves have proved deficient because their construction must allow for some radial expansion so that the sleeve can both pass over the mandrel when pressurized air is supplied thereto, and then be securely fixed to the mandrel by means of interference fit when that air supply is removed. This generally mandates that the sleeve construction must include a compressible composite, usually fibrous, material on its inner surface and along its entire length which can expand to a sufficient degree under air pressure so that it can slide over the bridge mandrel. Unfortunately, such composite materials, particularly fibrous ones, tend to be absorbent to liquids, and worse, such absorbency tends to result in some expansion of the material, generally compromising the dimensional uniformity of the sleeve which in turn results in an uneven application of the coating fluid. Thus, the current coating cylinders tend to deteriorate in performance and ultimately disintegrate, particularly at their end regions where the ingress and absorption of the aggressive coating liquids with which the sleeve comes into contact is most pronounced. Furthermore, not only is the performance of the Gravure coating sleeve compromised, there is the much more serious problem that, in extreme cases, the absorbent material expands to such a degree that the sleeve can no longer be removed from the bridge mandrel and it becomes effectively seized to it.

It is therefore an object of the present invention to provide a sleeve construction, and in combination a sleeve and mandrel assembly, which is robust enough to withstand the rigors of the environment within the print machinery in which it is disposed, and which effectively eliminates fluid ingress into the compressible material from which it must necessarily be constructed while simultaneously providing an improved structural robustness and longevity, and which furthermore can easily, quickly and safely be removed and replaced by relatively low skilled operatives.

SUMMARY OF THE INVENTION

According to the present invention there is provided a substantially tubular sleeve having a longitudinal axis adapted for applying a printing or coating liquid to a substrate material or offset roller, said sleeve having a multi-layer construction primarily consisting of a first outer layer of a dimensionally stable substantially fluid-impregnable solid material around the exterior surface of which is affixed or applied a print or coating liquid receiving plate or layer, and at least one second layer of a relatively less dimensionally stable compressible material disposed inwardly of the interior surface of the first layer, characterized in that the sleeve further comprises at least one end ring of a dimensionally stable substantially fluid-impregnable solid material, said end ring comprising first and second body portions, one body portion being disposed radially to the outside of the other, one of said body portions being received within a rebate provided in an end radial surface of said first outer layer and retained therein by means of mating engagement between a substantially axially aligned surface of said end ring body portion and a correspondingly aligned surface of said rebate such that the alternate end ring body portion substantially overlies an end surface of the second inner layer so as to prevent fluid ingress into the compressible material through said end surface of said inner layer.

For the avoidance of doubt, it should be mentioned that the first and second body portions of which the end ring is comprised may be more of arbitrarily defined, as opposed to being clearly physically, structurally and visually recognisably distinct. To explain further, the end ring may be a simple ring structure, with the first body portion being defined as that portion including the exterior axial surface and extending radially inwardly by a thickness approximating that of the radial extent of the rebate in the first layer of the sleeve. The second body portion of the simple ring structure would then be the remainder, i.e. that portion including the axially innermost surface of the ring, and extending radially outwardly therefrom toward the first body portion. As the skilled reader will appreciate, the first and second portions in this embodiment are essentially merely arbitrarily defined parts of the body of the ring structure as a whole, which will be of preferably unitary construction. The reasons for this definition, and the variations of it, are described and illustrated in more detail in the specific description hereof below.

To further prevent the ingress of fluid into the end surface of the second inner layer, it is preferable that either an annular gasket is applied or affixed over the radial surface of the inner layer, or that an initially liquid, but ultimately curable or otherwise settable, gasket compound is applied to the radial surface of said inner layer, such being usefully termed 'a gasket layer', such that (most preferably) said gasket layer is slightly compressed after completely securing the end ring to the sleeve.

Preferably, the first layer is rebated along its inner circumferential edge so that the axial engagement surface provided by such rebating faces radially inwardly of said first layer. In an equally preferred alternate arrangement, the first layer is rebated along its outer circumferential edge so that the axial engagement surface provided by such rebating faces radially outwardly of said first layer.

Preferably, the end ring first body portion is disposed radially outwardly of the second body portion, and said end ring comprises a flange portion which extends radially outwardly from first body portion so as to substantially cover the remaining radial end surface of the first layer disposed radially to the outside of the rebate therein. In this arrangement, the first body portion provides the axial engagement surface which matingly engages the with the corresponding axial engagement surface of the rebate. For the alternate arrangement mentioned above, it is similarly preferable that the end ring first body portion is disposed radially outwardly of the second body portion, but in this instance, the second body portion takes the form of a flange portion which extends radially inwardly from first body portion so as to substantially cover the remaining radial end surface of the first layer disposed radially inwardly of the rebate, and also the radial end surface of the second layer provided on the inside of the first layer which would otherwise be exposed. In both arrangements, the first body portion provides the axial engagement surface which matingly engages the with the corresponding axial engagement surface of the rebate, the latter arrangement being a simple mechanical inversion of the first.

Preferably, that body portion of the end ring which substantially overlies the radial end surface of the inner layer does so in a manner which completely covers said inner layer radial surface and thus provide an effective cap therefor.

In the preferred arrangement wherein the rebate in the first layer is radially inwardly disposed, and a flange portion is provided which extends radially outwardly from the first body portion of the end ring to cover and thus cap the remaining radial surface of the first layer beyond the rebate, it is most preferred that any print or coating liquid receiving layer is affixed or otherwise applied to the sleeve after the end ring has been secured in place such that said print or coating liquid receiving layer effectively covers or at least masks the circumferential seam formed between axially innermost radially outermost edge of the flange portion, and the radially outermost edge of the remaining end surface of the first layer.

In a most preferred arrangement, after the end ring has been secured in place, and optionally after a print or coating liquid receiving layer has been applied to the exterior cylindrical surface of the sleeve, the radially outermost edge of the sleeve ends are chamfered, most preferably in a manner wherein the chamfer surface includes both a part of one or both of the first layer and any print or coating liquid receiving layer applied or affixed thereto, and also a part of the end ring. By this arrangement, the seam between the end ring and the first layer (or layer applied thereto) is not only completely visibly obscured but also physically disrupted by the chamfering process such that the seam itself is even more resistant to liquid ingress.

Most preferably the engagement surfaces of both rebate and the first or second body portion of the end ring are axially aligned with the longitudinal axis of the sleeve, and parallel therewith.

Most preferably the mating engagement between the engagement surfaces of the rebate and the first or second body portion of the end ring is either threaded in that the relevant body portion of the end ring is essentially screwed into the rebate of the first layer, or alternately the mating engagement may comprise an interference fit, wherein one or both of the end ring and the sleeve (and specifically the first layer thereof) is heated or cooled by a requisite amount to allow the relevant body portion of the end ring to be slid into and within the rebate, whereupon, after suitable respective thermal contraction or expansion of the respective part(s), engagement surfaces mate interferingly and are thus firmly secured to one another. In one possible embodiment, the engagement surfaces of the rebate and the first or second body portion of the end ring may be dowelled, and thus further mechanically secured to one another.

Most preferably, the sleeve comprises two end rings, one provided at either end thereof, and secured thereto in the manner described above. Accordingly, both radial end surfaces of the second compressible/fibrous layer, at either end of the sleeve, are effectively capped and ingress of liquid printing ink or coating fluid is effectively prevented.

Most preferably one or both of the mating engagement surfaces on the relevant first or second body portion of the end ring and the rebate are further provided with O-ring seals to further prevent the further passage of any print or coating liquid which may have penetrated the external seam between the end ring and the first outer layer (and/or print liquid or coating layer applied thereto). In an alternate arrangement, an O-ring seal may be provided in either or both of the radial surface of the rebate (as opposed to its axial engagement surface), and the axially innermost radial surface of the respective body portion which most preferably comes into mating contact with said rebate radial surface.

In a most preferred arrangement, and particularly when end rings are provided at either end of the sleeve, the innermost axial surface of one end ring is dimensioned so that it is disposed radially either outwardly or inwardly of the innermost surface of the second layer. In the case where the inner diameter of the innermost axial surface of the end ring is marginally larger (e.g. preferably <2 mm, more preferably <1 mm, and typically 0.5 mm) than the diameter of the innermost axial surface of the second layer, a small radial step, ledge or shoulder is defined in the interior cylindrical surface of the sleeve by that portion of radial surface of the second layer not covered by the respective body portion of the end ring. Alternatively, in the case where the inner diameter of the innermost axial surface of the end ring is marginally less (e.g. preferably <2 mm, more preferably <1 mm, and typically 0.5 mm) than the diameter of the innermost axial surface of the second layer, a small radial step, ledge or shoulder is defined in the interior cylindrical surface of the sleeve by that portion of end ring which extends inwardly of the sleeve and over the radial surface of the second layer. By providing such a shoulder, and regardless of which end of the sleeve that such a shoulder might be provided, it is possible to render the sleeve as 'handed', meaning that it is easy and quick for an operator to determine one end of the sleeve from the other, and thus which way round the sleeve should be inserted into the machine.

For example, in one embodiment, the mandrel within a print machine may be provided with a correspondingly shaped collar or rib at a far end thereof, and of corresponding depth (the far end being that disposed within the machine and opposite the free end) to the shoulder inside the sleeve provided by the remaining exposed annular radial surface of the second inner layer. In this case, any attempt to mount a sleeve in the wrong orientation would be immediately apparent, as the sleeve would not be capable of sliding completely over the mandrel, provided of course that only one end of the sleeve was provided with the appropriate internal shoulder, being an exposed annulus of the second inner layer. In other words, only a sleeve end provided with the enlarged diameter opening and the corresponding internal shoulder will be accepted by the mandrel and be capable of being slid therealong into its proper axial position. In an alternative (or possible additional) configuration, the front or free end of the mandrel may be rebated to a depth corresponding to the shoulder width provided by a reduced diameter (as compared to the diameter of the second inner layer) end ring. In this arrangement, the sleeve in the incorrect orientation would simply not fit over the mandrel at all, as the diameter of the aperture provided in the respective end ring would be too small to receive the mandrel free end, or would receive only that portion of it which had been rebated as described.

In either embodiment, most preferably, the axial length of the mandrel collar or rebate, is chosen such that abutment of the radially exposed surface of said collar or rebate and the shoulder so provided internally of the sleeve together ensure correct axial positioning of the sleeve on the mandrel.

In one possible embodiment, both ends of the mandrel and sleeve are configured in this manner, i.e. the mandrel is provided with a collar at its far end, and a rebate at its free end, and the sleeve is provided with end rings having respectively larger and smaller diameter apertures than the diameter of the inner second layer so that a pair of internal shoulders is defined within the sleeve.

In view of the above, the present invention should be considered as extending to:

- a sleeve in its own right,
- a combination of a sleeve as described and an appropriately designed expansible/contractable mandrel,
- a method of installing a sleeve as described on such a mandrel, and
- a method of assembling and/or manufacturing a sleeve having a construction as described by securing end rings at one or both ends thereof in the manner described herein.

Most preferably, the sleeve is comprised of the following layers, in radially increasing order (from inside to out):

- a base wrap layer, which is most preferably of a fiberglass composition,
- an expandable (or more accurately a compressible) layer, which is most preferably of a polymer, foamed and/or cellular composition,
- a composite build up layer,
- an aluminum layer (it is the aluminum tube which primarily provides the sleeve with its structural strength and rigidity)
- a Chromium Oxide and/or any other ceramic coating layer, directly applied to the aluminum layer and which provides the sleeve with its functional requirement of accepting printing or coating liquids;

Most preferably, the end ring is constituted primarily or exclusively of aluminum, which in a preferred embodiment may be anodized for strength, most preferably in predetermined color so that sleeves may be color coded. Further preferably, the end ring may also be coated with Chromium Oxide and/or any other ceramic material.

Although there are many advantages to the robust but lightweight and thus easily replaceable sleeves described above, perhaps the most important is their ability for preventing fluid ingress into the more absorbent, and in some cases, fibrous inner layers of the sleeve construction. This ability is a direct result of the nature and design of the mechanical interaction between end ring and sleeve—not only is the mating interface between end ring and aluminum first layer one which by its very nature enhances the structural characteristics of the sleeve (i.e. a screw-fit or interference-type connection), the design of the end ring and sleeve components is such that no direct linear fluid pathway exists between the exterior surface of the sleeve and the radial end surfaces of the absorbent inner layers of the sleeve. Most simply, any fluid which actually manages to seep into the seam between the end ring and the first outer layer (or coating thereon) is required to travel around at least one if not two right-angled corners within that seam before it can finally traverse the entire seam and come into contact with any radial end surface of the absorbent inner layers of the sleeve. This is achieved because the seam or join between the respective portions of the end ring and corresponding respective portions of the sleeve has at least two separate portions which are axially separate from one another.

This advantage particular advantage and others, and indeed the most preferred embodiments of the invention will become apparent from the following specific description, provided by way of example and with reference to the accompanying drawings wherein.

DETAILED DESCRIPTION

Figure 1:
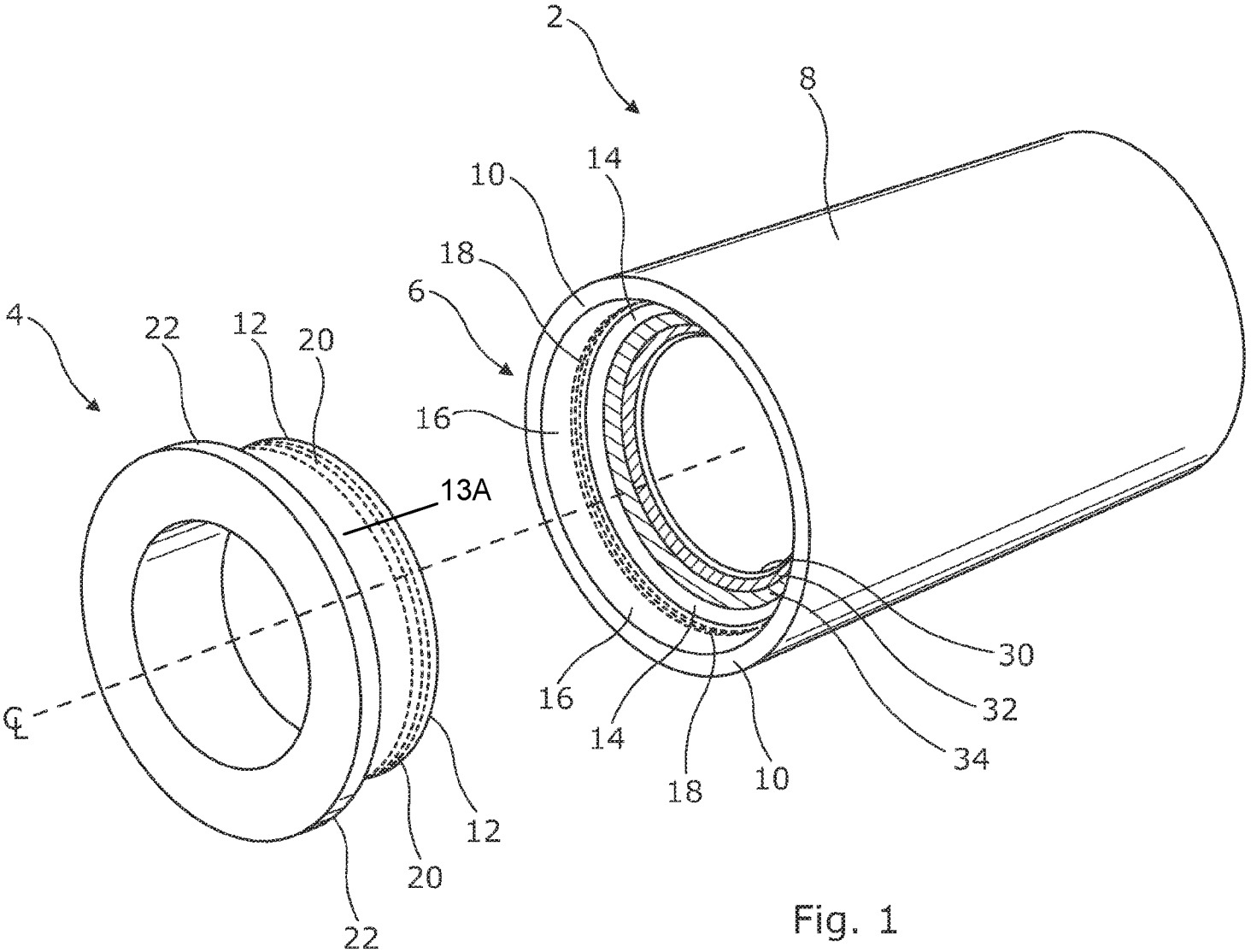
FIG. 1 shows an exploded perspective view of one end of a sleeve according to the invention, together with an end ring adapted for screw fit into said end.

Referring firstly to FIG. 1, there is shown a perspective view of a sleeve and corresponding end ring according to the invention and indicated generally at 2 and 4 respectively. An open end 6 of the sleeve is illustrated prior to screw-fitting insertion of the end ring 4 therein to facilitate understanding of the design specifics of the particular sleeve end 6. In general, the sleeve 2 is of generally tubular construction, and in practically all circumstances, the sleeve will be geometrically cylindrical (although other cross-sections are certainly possible and should be considered as encompassed herein). The primary structural component of the sleeve itself is an annular aluminum or steel tube 8 (which in FIG. 1 is not shown with any coating or printing plate layer yet applied or affixed to the exterior surface for clarity, but which is in practice is commonly required). The open end 6 of the tube 8 is internally rebated which:

- enlarges the internal diameter of the tube in the end region,
- reduces the wall thickness of the tube in the end region, and
- defines an internal shoulder at some short (typically of the order of 5-25 mm) distance axially inside the tube remote from the open end 6.

Thus, after internal rebating, an outermost radial annular surface 10 is provided which defines an opening which receives a correspondingly shaped and sized tubular shank portion 12 of the end ring 4, and axially inwardly of the open end 6, there is provided a shoulder 14 which an outer portion of the end-most radial planar surface of said end ring shank portion 12 preferably ultimately abuts as the said shank portion is fully received in the sleeve open end 6. The rebating process also further defines an axial inner surface 16 in the sleeve open end, and as is shown in FIG. 1, screw thread formations 18 are ideally provided in the axially innermost region of said axial inner surface 16, and corresponding screw threads 20 are provided towards the free axial end of the shank portion 16 on the outermost axial surface thereof. By such means, not only can the end ring 4 be received within the open end 6 of the tube 8, but it can be exceedingly firmly secured therein.

As may also be seen in FIG. 1, the end ring 4 is provided with a peripheral flange 22 which effectively enlarges the outermost diameter of the end ring in its axially outermost region, an most preferably, dimensionally, said flange 22 is exactly the same diameter as that of the outermost radial annular surface 10 so that, once the end ring is fully received and screwed into the open end 6, said flange abuts said radial annular surface 10 in planar mating fashion and thus defines a barely visible seam therebetween. The end ring 4 comprises first and second body portions 13A, 13B with the flange 22 extending radially outwardly from the first body portion 13A, as shown in FIGS. 1, 2, 2A and 3.

In terms of the interior of the tube 8, as is common for expandable sleeves, multiple further layers are provided around the innermost axial cylindrical surface of the tube, and in FIG. 1, three such layers are referenced at 30, 32, 34. Although for sleeves adapted for certain specific applications, there may be more or less, but in accordance with the invention, and to render the sleeve internally expandable to at least some degree, at least one such layer must be formed from a material which is relatively dimensionally much less stable than the aluminum (or steel) of which the sleeve itself is primarily constructed.

Specifically, in this embodiment, layer 30, the innermost layer, is known as the base wrap layer, and is commonly of a fiberglass-type material, or in some cases, a glass (or other) fiber reinforced plastics or polymer material. To the radially cylindrical surface of layer 30 is then provided a compressible layer 32, and to the radially outer surface thereof is provided further layer 34, commonly known as a composite build-up layer, and it is the radially exterior-most cylindrical surface of this layer which interfaces with the innermost axial surface of the tube 8.

Figure 2:
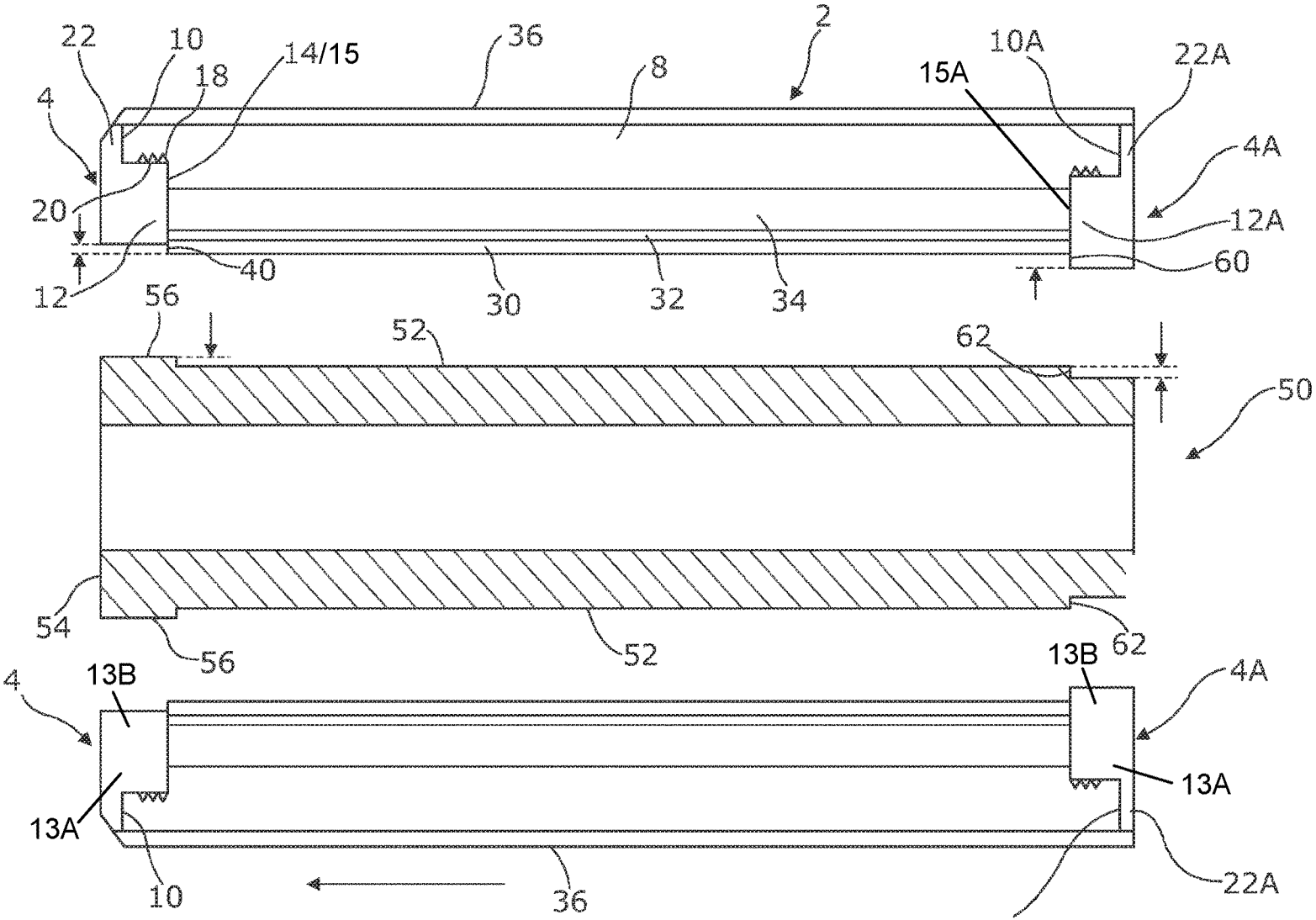
FIGS. 2 and 2A show schematic exploded sectional elevations through alternate embodiments of a bridge mandrel and a sleeve adapted to be slidingly received thereover.

Referring now to FIG. 2, in which a sectional elevation of an assembled sleeve 8 with end ring 4 screwingly disposed in the formerly open end 6 is illustrated, the various layers 30, 32, 34 are provided inside the tube 8 such that their annular radial end surfaces (visible in FIG. 1) are in substantially co-planar with the annular radial surface of shoulder 14. Additionally in this FIG. 2, a further coating layer 36 is shown having been chemically or mechanically applied or affixed to the exterior axial cylindrical surface of the tube 8. Most preferably, the coating will be a Chromium Oxide coating as is known in the art, and will be thermally or chemically applied after the end rings are securely fixed to either end of the tube 6 so that a portion of said coating layer covers the axial end surfaces of the flange portion 22 (22A for end ring 4A at the opposite end of the tube 8 from end ring 4) and thus covers the seam formed between the flange portions 22, 22A and the respective radial surfaces 10 (10A) of the tube 8 with which they mate. Of course, in alternative configurations, the coating may be replaced by, or may be provided on, a cylindrical printing plate mechanically affixed around said exterior surface of the tube 8, but in either case it is preferred that the said seam is covered, for reasons specifically described below.

It can also be seen in FIG. 2 that when respective threaded portions 18, 20 on tube inner axial surface 16 and end ring shank 12 respectively are fully engaged, and the end ring is thus completely received and securely fixed within tube open end. In this arrangement, a number of important mechanical interactions are achieved:

- flange 22 of the end ring matingly engages with the annular radial surface 10 of the tube in a seam which provides a first barrier to liquid ingress,
- the shank portion 12 of the end ring is dimensioned and designed so that a first portion comes into mating abutting relation with the internal shoulder 14 of the tube, and a second portion (radially inwardly of the first portion) comes into mating abutting relation with at least one, preferably two or more, of the inner layers 30, 32, 34 so that the radial end surfaces of such layers are effectively covered and capped (which are most preferably co-planar with the radial surface of the shoulder 14), thus providing a yet further barrier to liquid ingress into such surfaces, and
- the path that any liquid would need to travel before reaching the radial end surfaces of the covered and capped inner layers 30, 32, 34 is tortuous in that it would involve two right-angled turns, specifically, it would need to seep in through the seam defined between end ring flange portion 22 and tube outermost radial end surface 10, turn through 90° in a first axially inward direction at axially outermost region of the end ring shank portion 12, and then again through 90° to flow in a radial direction along the axial innermost radial surface of the end of said end ring shank portion before coming into contact with the radial surfaces of any of the inner layers, 30, 32, 34.

Thus by carefully designing and dimensioning both tube 8 and end ring 4, the resulting sleeve can be not only structurally very robust, but also practically impregnable to liquid.

To further prevent the ingress of fluid into the end surfaces of the inner layers 30, 32, 34 it is preferable that either an annular gasket 15, 15A is applied or affixed over the radial surface of the inner layers 30, 32, 34, or that an initially liquid, but ultimately curable or otherwise settable, gasket compound is applied to the radial surface of said inner layer 30, 32, 34, such being usefully termed 'a gasket layer', such that (most preferably) said gasket layer 15, 15A is slightly compressed after completely securing the end ring 4, 4A to the sleeve 2.

One further feature of the invention not specifically illustrated is the possible provision of one or more O-ring seals provided at one or more positions along the seam formed between the end ring flange (or body portion(s)) and the corresponding adjacent surface of the tube radial end surface 10 (or the axial engagement surfaces formed by the rebate). Those skilled in the art will immediately understand the additional benefit that such O-ring seals will provide as far as liquid ingress and travel within said seam is concerned.

Although screw thread formations are described above as providing the mechanical connection between end ring 4 and tube 6, it is certainly contemplated that other mechanical connections are possible, such as, for example, interferingly fitting the end ring within the open end of the tube 6.

It is also to be noted in FIG. 2 that further preferred features of the invention are shown. Specifically, the internal diametral dimensions of one (or both) of the end rings 4 (4A) are carefully chosen so as to leave an exposed internal annular shoulder 40, most preferably being (radially) only a portion of the innermost layer 30, but in other embodiments, the shoulder 40 may be defined entirely by the innermost layer 30, or it may be defined by the innermost layer 30 and a part of the layer 32. Regardless of how and by which particular layer said shoulder might be defined, its purpose is to render the sleeve 2 'handed' as regards a mandrel 50 over which it is adapted to be slid, and to which it is ultimately secured, most preferably by interference fit as previously mentioned. Although FIG. 2 is schematic in that it shows the sleeve 2 exploded for clarity, in practice, the innermost axial surface of the innermost layer 30 mates with an exterior cylindrical surface 52 of said mandrel, and most preferably the far end 54 of mandrel 50 (being that end which is effectively inaccessible to an operative wishing to extract either sleeve or mandrel from the print machinery in which they are mounted) is further provided with a collar 56 which is axially the same length as the end ring 4 and of the same height as the radial thickness of shoulder 40 so that the sleeve can only be completely slid over the mandrel and properly disposed thereon only if the sleeve is correctly orientated, that is with the end in which end ring 4 is disposed being fed over the mandrel first. At the alternate end of the mandrel, where end ring 4A is provided, a similar arrangement is also provided, though in this case the innermost diametral dimension of the end ring is less than the innermost diametral dimension of the innermost layer 30 so that an internal shoulder 60 is defined by the axially innermost radial surface of the shank portion 12A of that end ring. A free end 58 of the mandrel 50 is shown rebated around its exterior surface so as to provide a corresponding shoulder 62 which comes into abutting mating relation with the shoulder 60, such only being capable of being achieved when the sleeve is attempted to be fitted to the mandrel in the correct orientation. Thus with end rings 4, 4A having openings of slightly different diameters, and the mandrel itself having collar 56 and a rebate provided around its front end 58, different portions of the sleeve provide different clearanced fits around corresponding different portions of the mandrel.

A yet further preferred feature of the invention is illustrated in FIG. 2, particularly as regards the seam formed between the flange portions 22, 22A of the end rings, and the outermost radial end surfaces 10, 10A of the tube which forms the mandrel. As can be seen for end ring 4, the outermost edges of the flange portions 22 are preferably chamfered off in a manner which results in any one or more of the following:

- the seam formed between flange portion 22 and tube outermost radial surface 10 being included within the chamfer,
- the chamfer surface being comprised of only a part of the flange portion 22 (22A) of the end ring 4 (4A), and a part of coating layer 36 (or printing plate), and
- the chamfer surface being comprised only of the coating layer 36 (or printing plate) so that the underlying seam betwixt flange portions 22 (22A) and tube axially outermost radial surfaces 10 (10A) is entirely concealed and thus effectively sealed off by said coating layer 36 (or printing plate).

Such arrangements provide yet further improved resistance to liquid ingress into the seam.

Figure 2A:
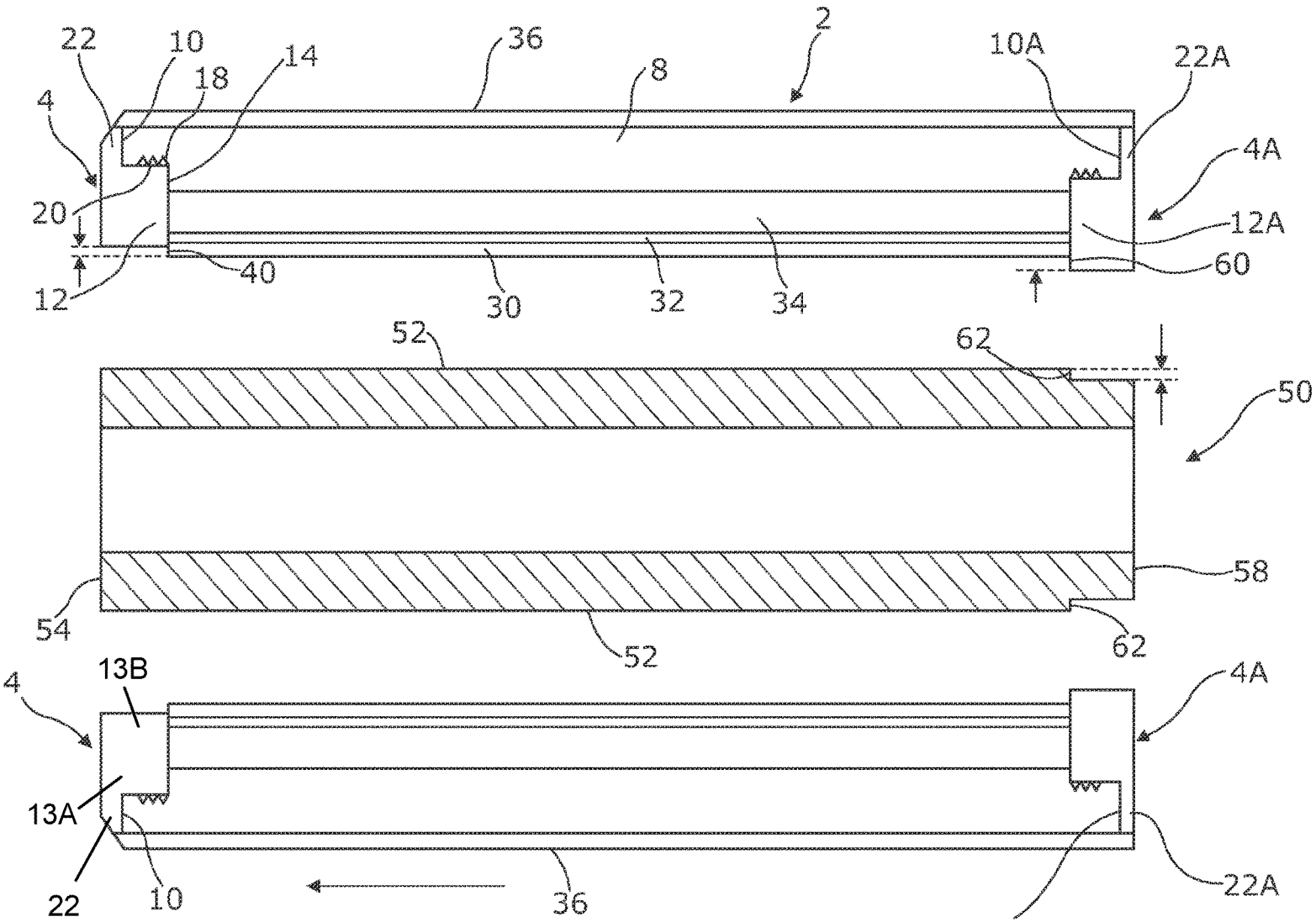

Referring briefly to FIG. 2A, an alternative embodiment is illustrated in which the mandrel 50 is provided only with a rebate around its free end 58 (i.e. without collar 56 as illustrated in FIG. 2) so as to define only a single shoulder 62 which comes into abutting mating relationship with the shoulder 60 defined in the end ring 4A, provided of course that the sleeve 2 is in the orientation shown in FIG. 2A. In both the embodiments shown in FIGS. 2 and 2A, if the sleeve orientation were reverse, then it would be impossible to slide the sleeve over the mandrel beyond the shoulder 62 because the interior diameter of the end ring 4A is less than that of the cylindrical surface 52 of said mandrel. Additionally, it can be seen in FIG. 2A that the sleeve 2 may still be provided with an exposed shoulder 40 of layer 30, and in certain embodiments, the collar 56 provided on the far end 54 of the mandrel (FIG. 2) may be replaced with an annular gasket or O-ring seal (not shown) of a thickness which both permits the innermost axial surface of end ring 4 to slide thereover, and additionally provides a seal therewith to prevent fluid ingress into the otherwise exposed radial surface of layer 30, i.e. the shoulder 40. Regardless of whether a gasket or O-ring of this type is provided, one reason for retaining the exposed shoulder 40 is to provide a means for operatives to quickly identify which end of the sleeve is which, and thus correctly orientate the sleeve prior to any attempt to slide the sleeve over the mandrel.

Figure 3:
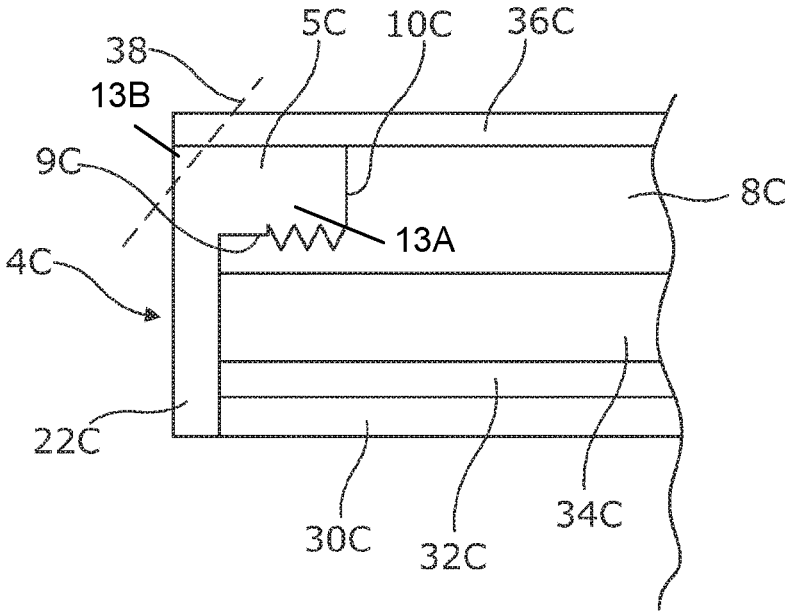
FIG. 3 shows a schematic sectional elevation of an alternate embodiment of one end of a sleeve with an end ring secured therein.

Referring finally to FIG. 3, an alternate assembly configuration is illustrated whereby the end ring 4C may be secured to and within the radial end surface 10C of the tube 8C. In FIG. 3, the rebate is provided in and around the exterior axial surface of the tube 8C, and the end ring 4C takes the form of a cap which is screwed onto the tube 8C by means of corresponding threads provided in both an axial inner surface of an end ring web portion 5C and an axial outer surface 9C in an end region of said tube. In this embodiment, end ring 4C is provided with a radially inwardly extending flange portion 22C which is shown in mating relation with the otherwise exposed radial end surfaces of inner layers 30C, 32C, 34C so as to effectively cover them and thus prevent ingress of liquid therein. Coating layer 36C is again applied after connecting the end ring 4C to the tube 8C, again effectively concealing the radial seam defined between the end ring and the outermost radial end surface 10C of the tube 8C. Dotted line 38 provides an indication of how the sleeve may be chamfered, as previously described.

In all embodiments therefore, the end ring is very securely mechanically affixed to the tube end, and the end ring and sleeve are together carefully designed and dimensioned such that a part of the end ring effectively covers and caps (at least partially) the otherwise exposed radial end surfaces of the inner layers 30, 32, 34 which are most commonly of a more absorbent material than that of which the tube 8 is constructed.

In summary therefore, a substantially tubular interchangeable sleeve adapted for applying a printing or coating liquid to a substrate material or offset roller is disclosed. The sleeve has a multi-layer construction primarily consisting of a first outer layer of a dimensionally stable substantially fluid-impregnable solid material, such as aluminum or steel, around the exterior surface of which is affixed or applied a printing ink or coating liquid receiving plate or layer. The sleeve further comprises one or more further interior layers of relatively less dimensionally stable, compressible usually fibrous materials disposed inwardly of the interior surface of the first layer which, under air pressure, can be compressed so as to enlarge the inner dimensions of the sleeve so that it can be slid over a suitable bridge mandrel. The sleeve further comprises at least one end ring of a dimensionally stable substantially fluid-impregnable solid material. The end ring comprises first and second body portions, one being disposed radially to the outside of the other, so that when one of said body portions is received within a rebate provided in a radial end surface of the first outer layer and retained therein by means of mating engagement between a substantially axially aligned surface of the end ring body portion and a correspondingly aligned surface of the rebate, the alternate end ring body portion partially or completely overlies one or more of the radial end surfaces of interior layers so as to prevent fluid ingress into that or those layers. An assembly of such a sleeve and a bridge mandrel on which it may be mounted is additionally described.

The invention claimed is:

1. A substantially tubular sleeve having a longitudinal axis adapted for applying a printing or coating liquid to a substrate material or offset roller, said sleeve having a multi-layer construction primarily consisting of:

a first layer of a dimensionally stable substantially fluid-impregnable solid material around an exterior surface of which is affixed or applied an outer coating layer;

at least one second layer of a compressible material relatively less dimensionally stable than the first layer and disposed inwardly of an interior surface of the first layer;

at least one end ring of a dimensionally stable substantially fluid-impregnable solid material, said end ring comprising first and second body portions, the first body portion being disposed radially to the outside of the second body portion, the first body portion being received within a rebate provided in a radial end surface of said first layer and retained therein by means of mating engagement between a substantially axially aligned surface of said end ring first body portion and a correspondingly substantially axially aligned surface of said rebate, said at least one end ring further comprising a flange portion which extends radially outwardly from the first body portion so as to cover the radial end surface of the first layer disposed radially to the outside of the rebate therein; and a gasket layer positioned between an end surface of the at least one second layer and the second body portion;

wherein the mating engagement between the rebate and the first body portion of the end ring is by corresponding screw threads provided on both the rebate and the end ring first body portion; and wherein when respective threads of the rebate and first body portion are engaged, the second body portion substantially overlies the end surface of the at least one second layer and the second body portion slightly compresses said gasket layer so as to prevent fluid ingress into said at least one second layer.

2. A sleeve according to claim 1, wherein the rebate provided in the first layer is provided along and around an inner circumferential edge of the first layer so that the axially aligned surface provided by such rebating faces radially inwardly of said first layer.

3. A sleeve according to claim 1, wherein the second body portion of the end ring which substantially overlies the end surface of the at least one second layer does so in a manner which completely covers said at least one second layer end surface.

4. A sleeve according to claim 1, wherein the axially aligned surfaces of both the rebate and the first body portion of the end ring are one or both of:

axially aligned with the longitudinal axis of the sleeve; and parallel with the longitudinal axis of the sleeve.

5. A sleeve according to claim 1, wherein the sleeve comprises two end rings, one provided at either end thereof.

6. A sleeve according to claim 1, comprised of the following substantially tubular layers, in radially increasing order:

a fiberglass base wrap layer of the at least one second layer;

a compressible layer of the at least one second layer of one of: a polymer, foamed and/or cellular composition;

a composite build up layer of the at least one second layer;

the first layer being a substantially dimensionally stable fluid-impregnable metallic layer, being one of aluminum or steel; and the coating layer, being one of: Chromium Oxide and a ceramic.

7. A sleeve according to claim 1, wherein the at least one end ring is constituted primarily or exclusively of one of: aluminum, steel, anodized aluminum, and anodized steel.

8. A sleeve according to claim 1, wherein the coating layer effectively covers a circumferential seam formed between the end ring and an outermost radial surface of the first layer when the end ring is fully secured to said first layer.

9. A sleeve according to claim 8, wherein radially outermost edges of the sleeve ends are chamfered to form a chamfer surface.

10. A sleeve according to claim 9, wherein the chamfer surface is defined partially or completely by any one or more of:

the coating layer; and the end ring.

11. A sleeve according to claim 1, wherein an innermost axial surface of the at least one end ring is dimensioned so that the innermost axial surface of the at least one end ring is disposed one of: radially outwardly and radially inwardly, of an innermost surface of the at least one second layer so that a shoulder is defined in an interior cylindrical surface of the sleeve, by, respectively, an exposed annular radial surface of the at least one second layer, or an exposed annular radial surface of the end ring.

12. An assembly comprising the sleeve of claim 11 and a mandrel, wherein said mandrel is provided with a corresponding shoulder provided in a substantially cylindrical outer surface and which the shoulder of the sleeve comes into abutting relation with to prevent further axial travel of the sleeve relative to the mandrel.

13. A sleeve according to claim 1, wherein the gasket layer is any one of: an annular gasket; and an initially liquid and ultimately curable gasket compound.

* * * * *